US007568929B1

(12) United States Patent
Su et al.

(10) Patent No.: US 7,568,929 B1
(45) Date of Patent: Aug. 4, 2009

(54) AUDIO JACK CONNECTOR AND CONNECTOR ASSEMBLY INCORPORATING THE SAME

(75) Inventors: Yu-Hung Su, Tu-Cheng (TW); Yao-Ting Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/232,284

(22) Filed: Sep. 15, 2008

(51) Int. Cl.
*H01R 29/00* (2006.01)

(52) U.S. Cl. ..... 439/188

(58) Field of Classification Search ..... 439/188, 439/489, 668, 669; 200/51.09
See application file for complete search history.

(56) References Cited

U.S. PATENT DOCUMENTS 1,497,586 A * 6/1924 Prall ..... 200/51.09
7,361,062 B2 * 4/2008 Long et al. ..... 439/668

* cited by examiner

*Primary Examiner*—Phuong K Dinh
(74) *Attorney, Agent, or Firm*—Rosenberg, Klein & Lee

(57) ABSTRACT

An audio jack connector adapted for mating with a plug connector which has an insulating loop thereon includes a dielectric housing, a plurality of signal terminals, and a set of switch terminals. The dielectric housing defines an inserting hole therethrough. The signal terminals are received in the dielectric housing. The set of switch terminals include a first switch terminal and a second switch terminal disposed in the dielectric housing. The second switch terminal has a contact portion extending into the inserting hole. When the plug connector is fully inserted into the inserting hole, the signal terminals are electrically connected with the plug connector, and the contact portion of the second switch terminal is against and pushed outwardly by the insulating loop of the plug connector to make the second switch terminal electrically connected with the first switch terminal.

5 Claims, 3 Drawing Sheets

AUDIO JACK CONNECTOR AND CONNECTOR ASSEMBLY INCORPORATING THE SAME

BACKGROUND OF THE INVENTION

1. Field of the Invention

The present invention generally relates to a connector, and more particularly to an audio jack connector and a connector assembly incorporating the same.

2. The Related Art

A conventional audio jack connector includes a dielectric housing, a set of switch terminals and a plurality of signal terminals. The switch terminals and the signal terminals are received in the dielectric housing. The dielectric housing defines an inserting hole in a front end thereof and passing therethrough. The switch terminals include a first switch terminal and a second switch terminal. The second switch terminal has a contact portion. When a complementary plug connector is inserted into the inserting hole of the dielectric housing, the contact portion of the second switch terminal is pushed by the plug connector to electrically connect with the first switch terminal. In this case, the audio jack connector can detect the insertion of the plug connector.

However, after the plug connector is fully inserted into the audio jack connector, the contact portion of the second switch terminal is also electrically connected with the plug connector, which interferes with the signal transmission between the audio jack connector and the complementary plug connector.

SUMMARY OF THE INVENTION

An object of the present invention is to provide an audio jack connector which can reduce the interference of the signal transmission between the audio jack connector and a plug connector. The audio jack connector adapted for mating with the plug connector which has an insulating loop thereon includes a dielectric housing, a plurality of signal terminals, and a set of switch terminals. The dielectric housing defines an inserting hole therethrough. The signal terminals are received in the dielectric housing. The set of switch terminals include a first switch terminal and a second switch terminal disposed in the dielectric housing. The second switch terminal has a contact portion extending into the inserting hole. When the plug connector is fully inserted into the inserting hole, the signal terminals are electrically connected with the plug connector, and the contact portion of the second switch terminal is against and pushed outwardly by the insulating loop of the plug connector to make the second switch terminal electrically connected with the first switch terminal.

Another object of the present invention is to provide a connector assembly. The connector assembly includes an audio jack connector and a plug connector. The plug connector has an insulating loop thereon. The audio jack connector adapted for mating with the plug connector includes a dielectric housing, a plurality of signal terminals, and a set of switch terminals. The dielectric housing defines an inserting hole therethrough. The signal terminals are received in the dielectric housing. The set of switch terminals include a first switch terminal and a second switch terminal disposed in the dielectric housing. The second switch terminal has a contact portion extending into the inserting hole. When the plug connector is fully inserted into the inserting hole, the signal terminals are electrically connected with the plug connector, and the contact portion of the second switch terminal is against and pushed outwardly by the insulating loop of the plug connector to make the second switch terminal electrically connected with the first switch terminal.

As described above, the second switch terminal is pushed by the plug connector to electrically connect with the first switch terminal for detecting the insertion of the plug connector. Furthermore, the contact portion of the second switch terminal is against the insulating loop of the plug connector, the second switch terminal is electrically insulated from the plug connector, which can reduce the interference of signal transmission between the audio jack connector and the plug connector.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
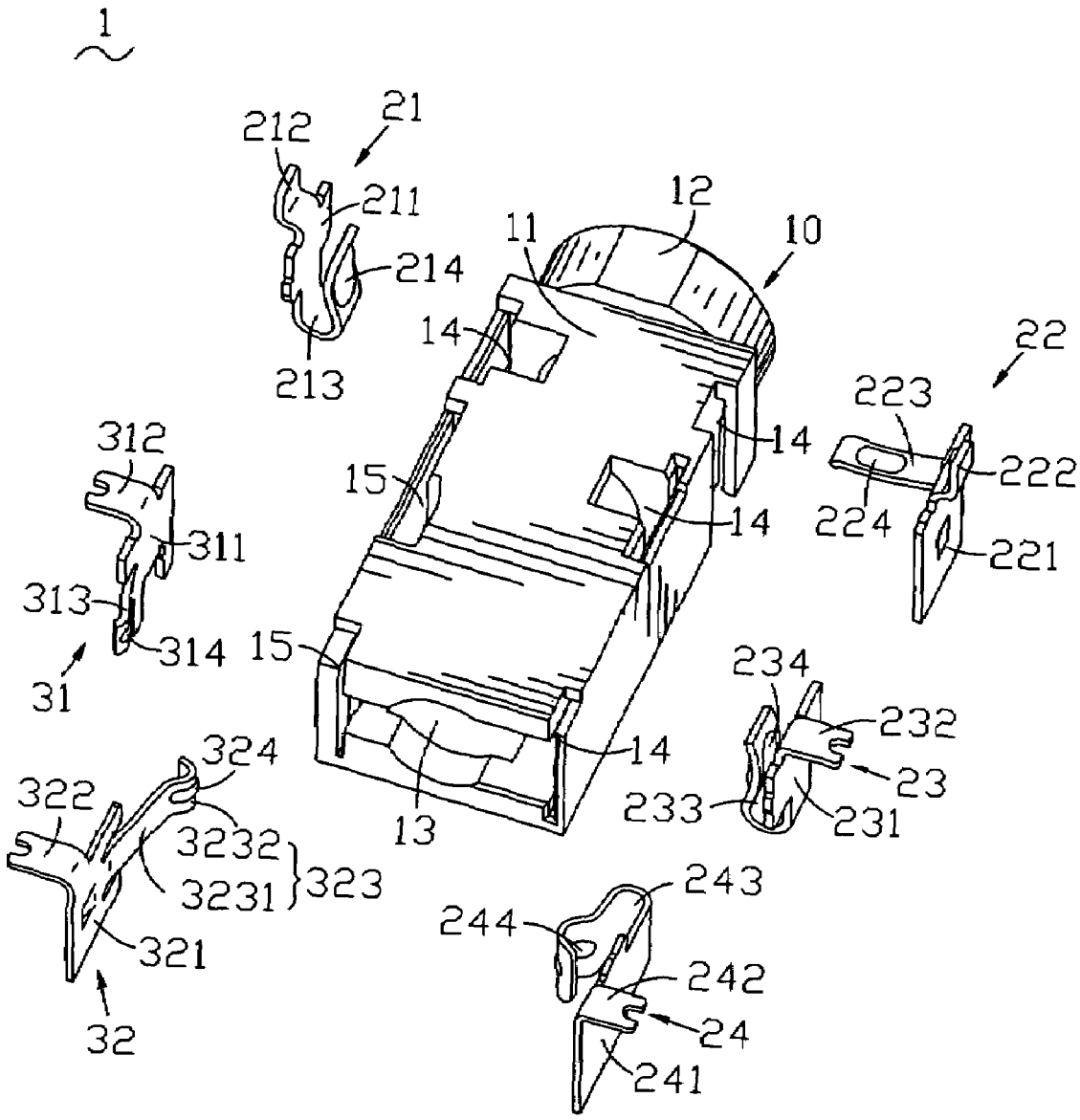
FIG. 1 is an exploded view of an audio jack connector in accordance with the present invention.
Figure 2:
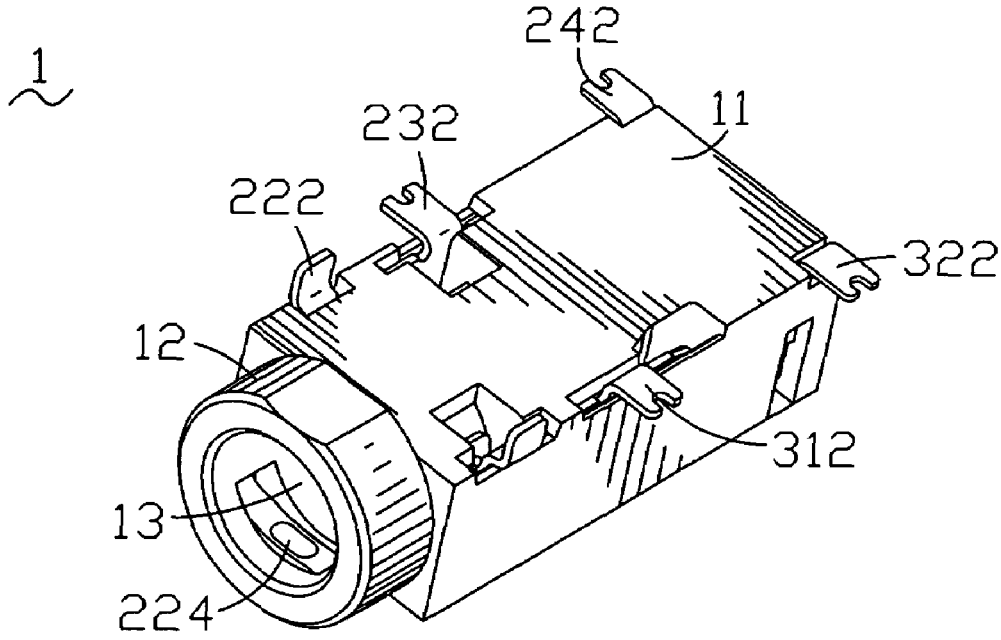
FIG. 2 is a perspective view of the audio jack connector shown in FIG. 1.

With reference to FIG. 1 and FIG. 2, an audio jack connector 1 according to the present invention includes a dielectric housing 10, a plurality of signal terminals and a set of switch terminals received in the dielectric housing 10.

The dielectric housing 10 has a basic portion 11 of a substantially rectangular shape. A mating portion 12 of a substantially cylindrical shape extends forward from an end of the basic portion 11. The mating portion 12 defines an inserting hole 13 which extends along the axis of the mating portion 12 and passes through the basic portion 11 and the mating portion 12. A plurality of signal terminal slots 14 and switch terminal slots 15 are defined in two sides of the basic portion 11 and communicate with the inserting hole 13.

Figure 3:
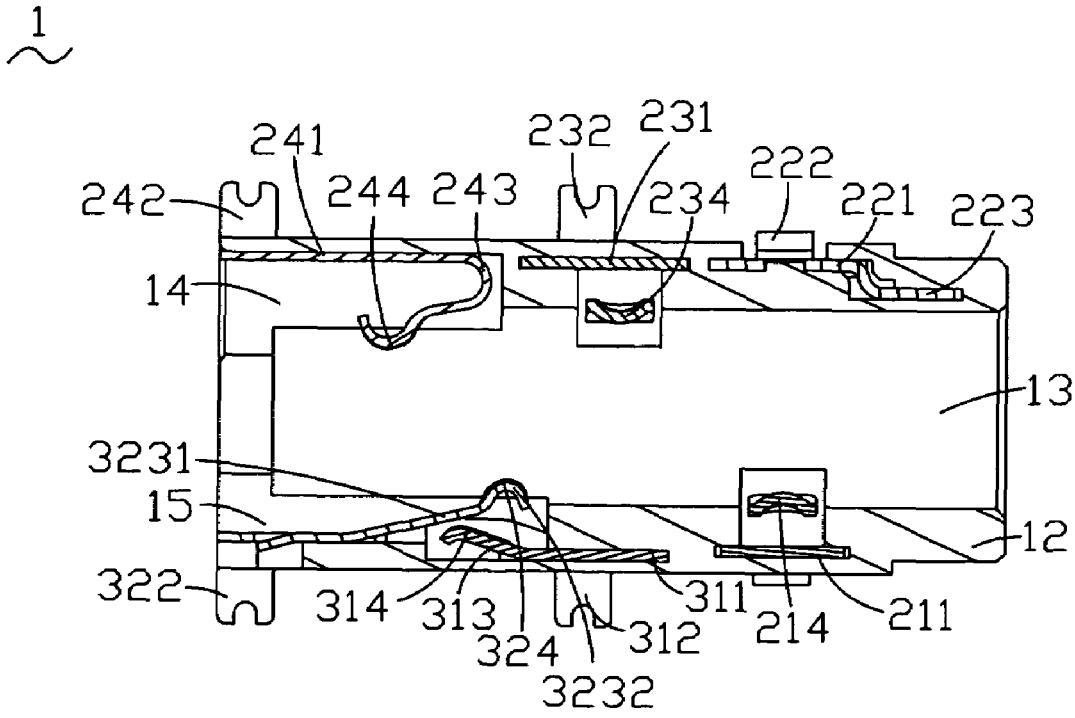
FIG. 3 is a cross-section view of the audio jack connector shown in FIG. 1.

Please refer to FIGS. 1 and 3, the signal terminals received in the dielectric housing 10 include a first signal terminal 21, a second signal terminal 22, a third signal terminal 23, and a fourth signal terminal 24. The first signal terminal 21 has a substantially rectangular first holding portion 211. A first soldering portion 212 is extended from one side of the first holding portion 211 and a substantially U-shaped first engaging portion 213 is bent and then extended from an opposite side of the first holding portion 211. A first contact spot 214 is protruded from a free end of the first engaging portion 213.

The second signal terminal 22 has a substantially rectangular second holding portion 221. A second soldering portion 222 is extended from one side of the second holding portion 221 and an L-shaped second engaging portion 223 is extended from an adjacent side of the second holding portion 221. A second contact spot 224 is protruded from a free end of the second engaging portion 223.

The third signal terminal 23 has a substantially rectangular third holding portion 231. A third soldering portion 232 is perpendicularly bent and extended from one side of the third holding portion 231 and a substantially U-shaped third engaging portion 233 is bent and then extended from an opposite side of the third holding portion 231. A third contact spot 234 is protruded from a free end of the third engaging portion 233.

The fourth signal terminal 24 has a substantially rectangular fourth holding portion 241. A fourth soldering portion 242 is perpendicularly bent and extended from one side of the fourth holding portion 241 and a substantially U-shaped fourth engaging portion 243 is bent and then extended from an adjacent side of the fourth holding portion 241. A fourth contact spot 244 is protruded from a free end of the fourth engaging portion 243.

The set of switch terminals includes a first switch terminal 31 and a second switch terminal 32. The first switch terminal 31 has a first fixing portion 311. A first soldering piece 312 is perpendicularly bent and extended from one side of the first fixing portion 311 and a first elastic contact arm 313 is extended slantwise from an adjacent side of the first fixing portion 311. A first switch contact spot 314 is protruded from a free end of the first elastic contact arm 313.

The second switch terminal 32 has a second fixing portion 321. A second soldering piece 322 is perpendicularly bent and extended from one side of the second fixing portion 321 and a second elastic contact arm 323 is extended slantwise from an adjacent side of the first fixing portion 311. The second elastic contact arm 323 includes a connecting portion 3231 extended from the second fixing portion 321 and a cambered contact portion 3232 bent and extended from a free end of the connecting portion 3231. A second switch contact spot 324 is protruded from a surface of the contact portion 3232.

In assembly, the first, second, third, fourth holding portion 211, 221, 231, 241 of the first, second, third, fourth signal terminal 21, 22, 23, 24 are respectively received in the corresponding signal terminal slots 14 of the dielectric housing 10. The first, second, third, fourth soldering portion 212, 222, 232, 242 extend out of the dielectric housing 10 to be soldered to a printed circuit board (not shown). The first, second, third, fourth engaging portion 213, 223, 233, 243 extend into the inserting hole 13 of the dielectric housing 10. The first, second fixing portion 311, 321 of the first, second switch terminal 31, 32 are received in the corresponding switch terminal slots 15 of the dielectric housing 10. The first, second soldering piece 312, 322 extend out of the dielectric housing 10 to be soldered to the printed circuit board. The contact portion 3232 of the second switch terminal 32 extends into the inserting hole 13 of the dielectric housing 10. The first elastic contact arm 313 of the first switch terminal 31 maintains a gap from the second elastic contact arm 323 of the second switch terminal 32 to ensure that the first switch terminal 31 and the second switch terminal 32 is in a non-contact state.

Figure 4:
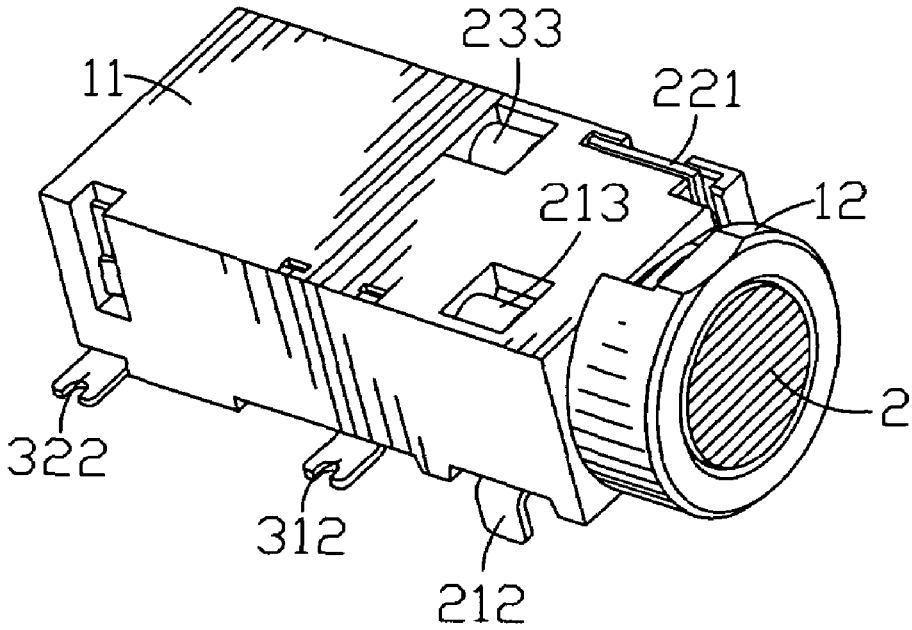
FIG. 4 is a perspective view of a connector assembly which is composed of the audio jack connector shown in FIG. 1 and a plug connector.
Figure 5:
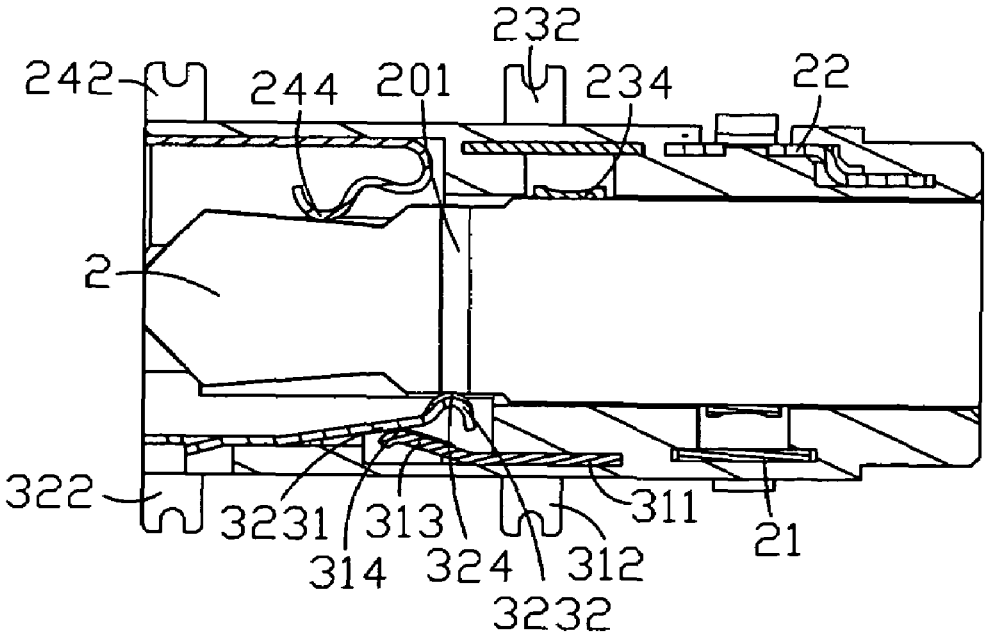
FIG. 5 is a cross-section view of the connector assembly shown in FIG. 4.

With referring to FIGS. 4 and 5, a connector assembly is composed of the audio jack connector 1 described above and a complementary plug connector 2. The plug connector 2 defines an insulating loop 201 therearound. When the plug connector 2 is fully inserted into the audio jack connector 1, the plug connector 2 is electrically connected with the first, second, third, fourth signal terminal 21, 22, 23, 24 to transmit the audio signals. The second switch contact spot 324 of the second switch terminal 32 is against by the insulating loop 201 of the plug connector 2. As a result of the push of the plug connector 2, the second elastic contact arm 323 is pushed outwardly to make the connecting portion 3231 of the second elastic contact arm 323 contact the first switch contact spot 314 of the first switch terminal 31. In this case, the first switch terminal 31 is electrically connected with the second switch terminal 32 to detect the insertion of the plug connector 2.

As described above, the second switch terminal 32 is pushed outwardly by the plug connector 2 to electrically connect with the first switch terminal 31 for detecting the insertion of the plug connector 2. Furthermore, the second switch contact spot 324 of the second switch terminal 32 is against the insulating loop 201 of the plug connector 2, therefore the second switch terminal 32 is electrically insulated from the plug connector 2, which can reduce the interference of the plug connector 2 from the switch terminals 31, 32.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector adapted for mating with a plug connector which has an insulating loop thereon, comprising:

A dielectric housing defining an inserting hole therethrough;

a plurality of signal terminals received in the dielectric housing; and a set of switch terminals having a first switch terminal and a second switch terminal disposed in the dielectric housing, the first switch terminal having a first fixing portion fixed in the dielectric housing and a first elastic contact arm, the second switch terminal having a contact portion extending into the inserting hole, the second switch terminal having a second fixing portion fixed in the dielectric housing, and a second elastic contact arm extending slantwise from one side of the second fixing portion, the second elastic contact arm being separated from the first elastic contact arm when the plug connector is not inserted into the dielectric housing;

wherein, when the plug connector is fully inserted into the inserting hole, the signal terminals are electrically connected with the plug connector, the contact portion of the second switch terminal is against and pushed outwardly by the insulating loop of the plug connector to make the second switch terminal electrically connected with the first switch terminal.

2. The audio jack connector as claimed in claim 1, wherein the dielectric housing further comprises a plurality of terminal slots disposed on two sides of the dielectric housing and communicating with the inserting hole for receiving the signal terminals and the switch terminals in the corresponding terminal slots.

3. The audio jack connector as claimed in claim 1, wherein the first elastic contact arm extends slantwise from one side of the first fixing portion, a first switch contact spot is protruded from the first elastic contact arm for electrically connecting with the second switch terminal.

4. The audio jack connector as claimed in claim 1, wherein the second elastic contact portion includes a connecting portion extending slantwise from the second fixing portion, and the contact portion of a cambered shape extending from a free end of the connecting portion, a second switch contact spot is protruded from the contact portion, when the plug connector is fully inserted into the dielectric housing, the second switch contact spot is against and pushed outwardly by the insulating loop of the plug connector.

5. A connector assembly, comprising:

a plug connector having an insulating loop thereon; and an audio jack connector adapted for mating with the plug connector, the audio jack connector comprising a dielectric housing defining an inserting hole therethrough;

a plurality of signal terminals received in the dielectric housing; and a set of switch terminals having a first switch terminal having a first elastic contact arm and a second switch terminal disposed in the dielectric housing, the second switch terminal having a contact portion extending into the inserting hole, the second switch terminal having a fixing portion fixed in the dielectric housing and a second elastic contact arm extending slantwise from one side of the fixing portion, the second elastic contact arm being separated from the first elastic contact arm when the plug connector is not inserted into the dielectric housing;

wherein, when the plug connector is fully inserted into the inserting hole, the signal terminals are electrically connected with the plug connector, the contact portion of the second switch terminal is against and pushed outwardly by the insulating loop of the plug connector to make the second switch terminal electrically connected with the first switch terminal.

* * * * *